US006228042B1

(12) United States Patent
Dungan

(10) Patent No.: US 6,228,042 B1
(45) Date of Patent: May 8, 2001

(54) CHIROPRACTIC ADJUSTING TOOL

(76) Inventor: Thomas E. Dungan, 5139 North Rd., North Street, MI (US) 48049

( * ) Notice: Subject to any disclaimer, the term of this patent is extended or adjusted under 35 U.S.C. 154(b) by 0 days.

(21) Appl. No.: 09/159,897

(22) Filed: Sep. 24, 1998

(51) Int. Cl.[7] ..... A61H 1/00
(52) U.S. Cl. ..... 601/107; 601/97; 601/101
(58) Field of Search ..... 601/107, 108, 601/97, 100, 101, 111, 103, 46, 67, 68, 69, 70, 72; 606/237, 238

(56) References Cited

U.S. PATENT DOCUMENTS 1,340,959 * 5/1920 Jones ..... 601/97
3,837,335 * 9/1974 Teranishi ..... 601/108
3,945,076 * 3/1976 Sung ..... 15/22.1
3,984,890 * 10/1976 Collis ..... 15/22.1
4,088,128 * 5/1978 Mabuchi ..... 601/101
4,495,940 * 1/1985 Takaishi ..... 601/108
4,513,737 * 4/1985 Mabuchi ..... 601/108
4,549,535 * 10/1985 Wing ..... 601/108
4,716,890 * 1/1988 Bichel ..... 601/108
4,841,955 * 6/1989 Evans et al. ..... 601/101
5,300,095 * 4/1994 Salazar ..... 601/108
5,626,615 * 5/1997 Keller et al. ..... 601/107

* cited by examiner

*Primary Examiner*—Justine R. Yu

(57) ABSTRACT

A chiropractic adjustment tool or tapper comprises a housing, the housing having an open end; a striker assembly disposed within the housing and secured thereto; and a plunger device or plunger disposed externally to the housing and secured thereto, the plunger being in communication with the striker assembly through the open end in the housing. The striker assembly comprises a reciprocating striking rod. A power source, such as a pneumatic motor, electric motor, solenoid arrangement, or the like, provides power through a series of gears and springs to move the striking rod in reciprocating fashion. The plunger comprises a plunging rod slidable within a body. Once each cycle, the striking rod strikes the plunging rod, which moves away from the striking rod and strikes the patient's body. Upon striking the patient's body, another spring retracts the plunging rod until it once again contacts the striking rod and is again forced against the patient's body. A typical rate of impact is thirty impacts per second, though other rates of impact are available and can be efficacious as well. Both the speed and the force of impact are adjustable to provide optimal therapeutic effects.

8 Claims, 2 Drawing Sheets

FIG 1
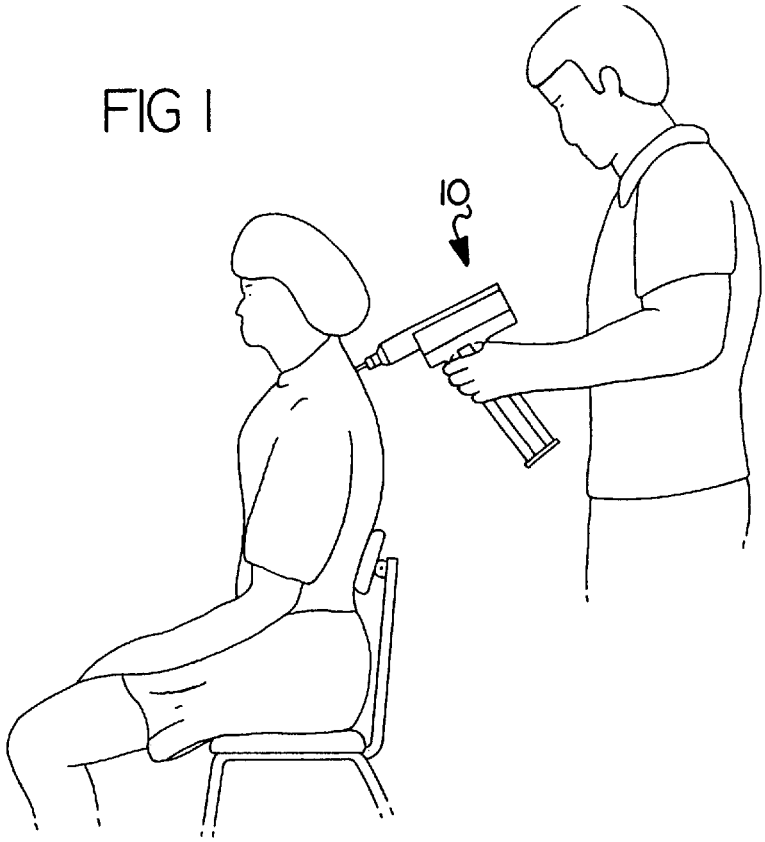
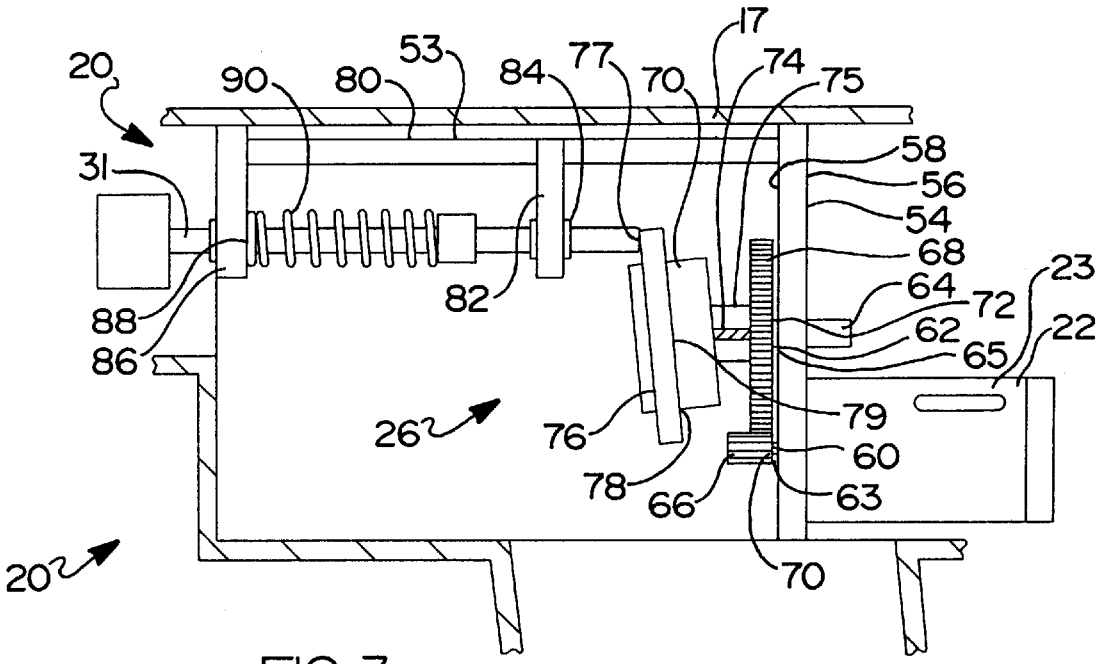
FIG 3

CHIROPRACTIC ADJUSTING TOOL

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention involves the field of medical devices. More particularly, it involves the field of medical devices used in chiropractic. Even more particularly, it relates to chiropractic adjustment tools used to move bones and relieve muscle spasms and stress.

2. Prior Art

As is well-known in the chiropractic art, the spines or other bones of humans sometimes go out of alignment or are otherwise mis-adjusted. This can lead to discomfort and, sometimes, additional physical symptoms. In such cases, an adjustment of the spine or other bone to a healthy alignment can have substantial therapeutic effects.

Several attempts have been made to provide hand-held or other small devices to assist in adjusting a patient's spine or other bone by the use of impacts against the bone. However, each of these devices provides only a single impact per application, as described below.

U.S. Pat. No. 4,016,873, issued Apr. 12, 1977 to Anderson, is entitled "PNEUMATIC IMPACTER." The patent teaches a pneumatic gun-type device with an impact cylinder which is released when a trigger is squeezed. The impact cylinder, when released by the trigger, is extended under pressure until it makes contact with a surface. The pressure is adjustable to permit the user of the device to set the pressure desired for a specific treatment. The device provides one impact per pull of the trigger.

U.S. Pat. No. 4,498,464, issued Feb. 12, 1985 to Morgan, Jr., is entitled "CHIROPRACTIC INSTRUMENT." The patent teaches a manually-operated instrument used to provide an impact to a specific surface of a body. The instrument has a plunger or cylinder-type device with a striking surface. The cylinder is movable within a hand-held chamber. The movement of the cylinder is controlled by a spring, which is contained within the chamber, and permits an adjustment of the tension applied by the cylinder. In use, a user of the device manually strikes it against a patient's body. The spring adjustment permits the user to determine the impacting pressure the person wishes to make on the patient's body. The device provides one impact per application.

U.S. Pat. No. 4,669,454, issued Jun. 2, 1987 to Shamos, is entitled "PERCUSSING CHIROPRACTIC DEVICE HAVING ADJUSTABLE SPRING FORCE." The patent teaches a body-impact device similar to the Morgan device discussed above. The device consists of a hand-held chamber having an anvil at one end and a spring-biased hammer mounted in the chamber. An elongated spindle is connected to the hammer for drawing the hammer away from the anvil into a loaded position in which the spring is compressed. Upon release of the spring, the hammer strikes the anvil, which strikes the patient's body. The level of tension is adjustable to provide impacts of varying strength to a patient's body. The device provides one impact per application.

As can be seen from the above, the prior art has provided several single-impact chiropractic devices. However, the prior art has not disclosed a multiple-impact device for providing therapeutic pressure to a patient's body. Multiple impacts are desirable because of the cumulative effect of the treatment provided therewith. The present invention is directed to this shortcoming in the prior art.

BRIEF SUMMARY OF THE INVENTION

The present invention provides a chiropractic adjustment tool or tapper, which, generally, comprises:

(a) a housing, the housing having an open end;

(b) a striker assembly disposed within the housing and secured thereto, the striker assembly comprising a power source, the power source providing operational power to the striker assembly; and (c) a plunger disposed externally to the housing and secured thereto, the plunger being in communication with the striker assembly through the open end in the housing.

The striker assembly comprises a reciprocating striking rod. A power source, such as a pneumatic motor, electric motor, solenoid arrangement, or the like, provides power through a series of gears and springs to move the striking rod in reciprocating fashion.

The plunger comprises a plunging rod that is slidable within a body. Once each cycle, the striking rod strikes the plunging rod, which moves away from the striking rod and strikes the patient's body. Upon striking the patient's body, a spring retracts the plunging rod until it once again contacts the striking rod and is again forced against the patient's body. A typical rate of impact is thirty impacts per second, though other rates of impact are available and can be efficacious as well. Both the speed and the force of impact are adjustable to provide optimal therapeutic effects.

For a more complete understanding of the present invention, reference is made to the following detailed description and accompanying drawings. In the drawings, like reference characters refer to like parts through the several views, in which:

BRIEF DESCRIPTION OF THE SEVERAL VIEWS OF THE DRAWING

FIG. 1 is an environmental view of an adjusting tool in accordance with the present invention;

FIG. 3 is a side view of a striker assembly of the adjusting tool of FIG. 1.

DETAILED DESCRIPTION OF THE INVENTION

Figure 2:
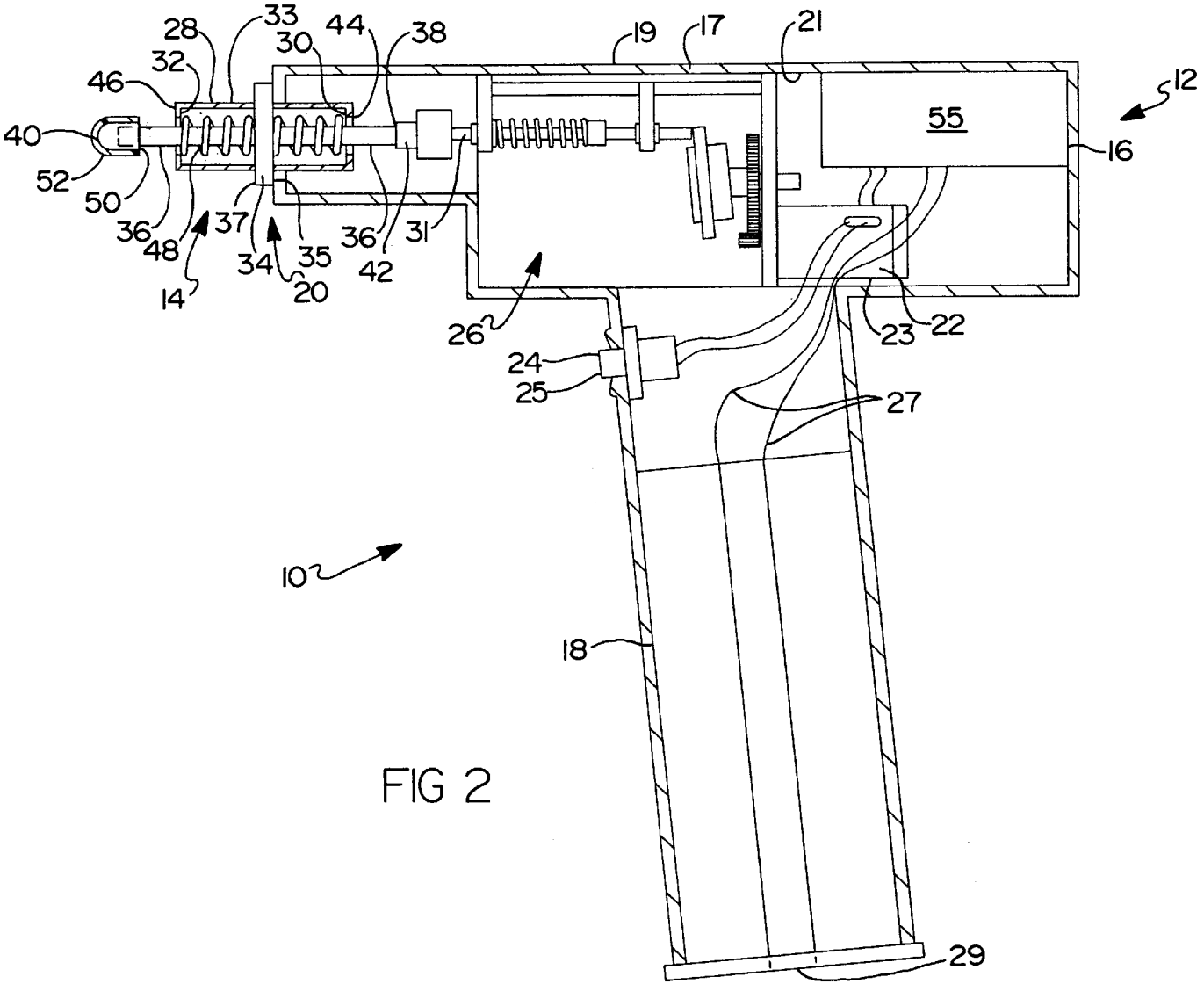
FIG. 2 is a side view of the adjusting tool of FIG. 1.

Referring to the drawing, there is depicted a chiropractic adjustment tool or tapper in accordance with the present invention, generally denoted at 10. The tapper 10, generally, comprises:

(a) a housing 12, the housing having an open end 20;

(b) a striker assembly 26 disposed within the housing and secured thereto, the striker assembly comprising a power source, the power source providing operational power to the striker assembly; and (c) a plunger 14 disposed externally to the housing and secured thereto, the plunger being in communication with the striker assembly through the open end in the housing.

The housing 12 is a hollow member having an outer shell 16, the shell having an outer surface 19 and an inner surface 21. The shell 16 is made of any convenient material, such as plastic, metal, or the like. The shell has a handle portion 18 to enable easy grasping and holding of the housing 12. The shell 16 also has a barrel portion 17 integral with the handle portion and bearing the open end 20. The inner surface 21 of the barrel 17 is, preferably, provided with thread 13 proximate the open end 20 to enable threading attachment of the plunger 14, as described hereinbelow.

As shown in FIGS. 2 and 3, the striker assembly 26 is disposed within the barrel 17. The striker assembly 26 comprises a frame 53. The frame 53 has a first plate 54, a second plate 80, a third plate 82, and a fourth plate 86. The first plate 54 is secured to the barrel 17 of the housing 12 by suitable fastening devices such as screws, rivets, or the like, thereby securing the entire striker assembly to the barrel. The plates of the frame 53 provide anchors for other elements of the tapper 10, as described below. The frame 53 is, preferably, made of a metal for durability, though other materials such as plastics can also be used if sufficiently durable.

The striker assembly 26 further comprises a power source 22. The power source 22 is operatively connected to a source of energy 23. The power source 22 and source of energy 23 may be of any convenient form, such as a pneumatic motor operatively connected to a compressed air source (not shown), or an electric motor operatively connected to a battery 55, or an electric motor operatively connected to a wall outlet, etc. Where a wall outlet is used, an electric power cord 27 is secured to the electric motor and extends through an aperture 29 formed in the shell 16. The aperture 29 enables the power cord 27 to emerge therethrough and plug into a wall outlet (not shown) to obtain electric energy therefrom in the well-known manner.

The power source 22 is operatively connected to means 24 for controlling the flow of power disposed on the outer surface 19 of the shell 16, such as a switch 25 or the like, in the well-known manner to enable a user to control the operation of the device by regulating the flow of power from the power source. The switch 25 may be in any well-known form, including a "trigger" or a "button," either of which plungingly closes the circuit to the power source if electric, controls the flow of air if pneumatic, etc.

The striker assembly 26 further comprises a reciprocating striking rod 31. The striking rod is axially elongated and has a forward first end defined by an enlarged diameter portion 92, a medial portion defined by an enlarged diameter portion 92, and a rearward second end 77. A coil spring 90 is disposed around the striking rod 31 with a forward end of the spring engaging the third plate 86 and a rearward end of the spring engaging the enlarged diameter portion 92. The striking rod 31 is, preferably, made of a metal for durability. The power source 22 provides power to propel the striking rod 31 forward and backward. If the power source 22 is an electric motor, the striking rod is propelled as described hereinbelow.

The first plate 54 has a first side 56 and a second side 58 opposite the first side, and has a first aperture 60 and a second aperture 62 spaced from the first aperture formed therethrough. The motor 22 and an anchor 64 are disposed on the first side 56 of the first plate 54 and are secured thereto by screws, rivets, or the like. A first gear 66 and a second gear 68 are disposed on the second side 58 of the first plate 54 opposite the motor 22 and the anchor 64, respectively. A first connecting rod 63 extends from the motor 22 through the first aperture 60 to the first gear 66, and is secured thereto by a bushing 70. A second connecting rod 65 extends from the anchor 64 through the second aperture 62 to the second gear 68, and is secured thereto by a bushing 72. The first gear 66 and the second gear 68 are in meshing engagement with each other.

The second gear 68 is integrally formed with a hollow shaft 74. The hollow shaft 74 extends around a hub 75 into an aperture 78 formed in a wheel 76, the hub 75 being integrally formed with the wheel 76. The hub 75 is mounted on the shaft 74 and secured thereto by least one rivet 79 or the like. So secured, the wheel 76 has a surface 81 which as a result of the mounting is tilted (i.e., inclined) to the axis of rotation of the shaft 74. As the shaft 74 turns, the wheel 76 alternately tilts toward and away from the shaft. The striking rod 31 has its rearward end 77 positioned for contact with the wheel 76 and projecting in a direction opposite the shaft 74.

As noted hereinabove, the first plate 54 secures the entire striker assembly to the barrel 17. The second plate 80 of the frame 53 is secured to the first plate 54 by suitable fasteners such as screws, rivets, or the like, or may be formed integrally therewith, and is normal thereto. The third plate 82 of the frame 53 projects upwardly from the second plate 80, spaced from the first plate 54, and is secured to the second plate 80 by suitable fasteners such as screws, rivets, or the like, or may be formed integrally therewith. An aperture 84 is formed through the third plate 82. The fourth plate 86 of the frame 53 projects upwardly from the second plate 80, spaced from the third plate 82 in the direction away from the first plate 54, and is secured to the second plate 80 by suitable fasteners such as screws, rivets, or the like, or may be formed integrally therewith. An aperture 88 is formed through the fourth plate 86 in alignment with the aperture 84 in the third plate 82.

The striking rod 31 slidingly extends through the aperture 84 in the third plate 82 and the aperture 88 in the fourth plate 86. Because the third and fourth plates are secured to the second plate 80, and the second plate is secured to the first plate 54, and the first plate is secured to the barrel 17 of the housing 12, the striking rod is thus slidingly secured within the barrel 17.

Means for biasing, such as the spring 90, is circumferentially disposed about the striking rod 31 between the third plate 82 and the fourth plate 86 to retract the striking rod 31 after an impact, as described hereinbelow.

When the power source 22 is engaged via the means for controlling 24, the first connecting rod 63 causes the first gear 66 to rotate. The motion of the first gear 66 causes the second gear 68, with which the first gear 66 is meshingly engaged, to rotate. The motion of the second gear 68 causes the shaft 74, with which the second gear 68 is integrally formed, to rotate. The rotation of the shaft 74 causes the wheel 76, which is securedly mounted on the shaft 74, to rotate. The motion of the wheel 76, which, as described hereinabove, alternatively tilts towards and away from the shaft 74 and and delete, "which which is intermittently contacted by the wheel 76 at the point 77 thereof to reciprocally move"; causes the striking rod 31, which is intermittently contacted by the wheel 76 at the point 77 thereof to reciprocally move to move away from the shaft, thus compressing the spring 90 disposed around the striking rod. When the wheel 76 rotates sufficiently that the the wheel 76 moves toward the shaft 74, the motion of the wheel causes the striking rod 31 to move toward the shaft, thus decompressing the spring 90 disposed around the striking rod.

Thus, the power source 22 provides power to the striking rod 31 to move the striking rod away from the shaft 74 and toward the open end 20 of the barrel 17 of the housing 12. The spring 90 then decompresses, propelling the striking rod 31 back away from the open end 20 and toward the shaft 74.

As noted hereinabove, the power source 22 may be a pneumatic motor. If a pneumatic motor is used, the striker assembly 26 comprises a turbine to provide power to propel the striking rod 31 forward and backward. Similarly, a solenoid arrangement may advantageously be used to provide power to propel the striking rod 31 forward and backward. Turbine and solenoid assemblies are well known to the skilled artisan, and as such are not detailed herein.

Regardless of the method by which the striking rod 31 reciprocates, the striking rod 31 engages the plunger 14 through the open end 20 of the barrel 17.

The plunger 14 comprises a hollow cylindrical body 28. The body 28 is made of any convenient material, preferably a metal for durability. The body 28 has a first end 30, an opposed second end 32, and an outer surface 33. The diameter of the cylindrical body 28 is substantially equal to the inner diameter of the barrel 17. The body 28 of the plunger 14 is provided with thread 11 on its outer surface 33. The threadings 11 and 13 respectively on the outer surface 33 of the body 28 of the plunger 14 and on the inner surface 21 of the barrel 17 proximate the open end 20 cooperate to enable threaded attachment of the plunger 14 to the barrel 17.

The plunger further comprises means 37 for adjusting the plunger. The means 37 for adjusting, preferably, comprises an annular ring 34 disposed around the body 28 of the plunger 14, the ring 34 having an inner surface 35. The ring 34 is made, preferably, of the same material as the body 28. The inner diameter of the annular ring 34 is substantially equal to the outer diameter of the body 28, and the outer diameter of the annular ring 34 is larger than the diameter of the barrel 17. The annular ring 34 is provided with thread 39 on its inner surface 35. The threadings 11 and 39, respectively on the outer surface 33 of the body 28 of the plunger 14 and on the inner surface 35 of the annular ring 34 cooperate to enable threaded attachment of the annular ring 34 to the body 28.

The annular ring 34 enables adjustment of the plunger 14, and thus of the tapper 10. The body 28 of the plunger 14 screws into the open end 20 of the barrel 17, as described hereinabove. However, the plunger 14 can screw into the barrel 17 only until the annular ring 34 encounters the forward end face of the barrel 17, as the outer diameter of the annular ring 34 is greater than the diameter of the barrel 17. Thus, by screwing the annular ring 34 nearer the first end 30 or the second end 32 of the body 28, less or more, respectively, of the body 28 may screw into the barrel 17.

The plunger 14 further comprises a reciprocating plunging rod 36 disposed within the hollow cylindrical body 28. The plunging rod 36 extends through the hollow body 28 of the plunger 14 and emerges from both the first end 30 and the second end 32 thereof, the plunging rod 36 being longer than the body 28 and slidable therewithin. The plunging rod 36 has a first end or striker-contacting end 38 and a second end or body-contacting end 40 corresponding to the first end 30 and the second end 32 of the body 28, respectively. The plunging rod 36 has an enlarged-diameter portion 42 at its first end 38 adjacent to the first end 30 of the housing 28. The diameter of the enlarged-diameter portion 42 is substantially similar to the enlarged diameter portion 42 of the striking rod 31 of the striker assembly 26, which is disposed within the barrel 17 as described hereinabove. The plunging rod 36 is, preferably, made of the same material as the striking rod 31 for durability. The plunging rod 36 percussively contacts a patient being treated by the tapper 10, using power from the power source 22 as delivered by the striking rod 31 and as described hereinbelow.

Bushings 44 and 46 are seated in the first end 30 and the second end 32, respectively, of the body 28 to seal the ends around the plunging rod 36.

Means for biasing, such as a spring 48, is disposed around the plunging rod 36 within the hollow body 28 to retract the plunging rod 36 after an impact, as described hereinbelow.

A tip 50 is mounted atop the plunging rod 36 at its second end 40. The tip 50 is formed, preferably, of synthetic rubber or another yielding material. A removable, disposable second tip 52 may be used with the device 10. Where used, the second tip 52 envelops the tip 50, to provide a hygienic surface for contact with a person to be treated by the tapper 10.

In use, the plunger 14 is screwed into the barrel 17. The amount of the plunger emplaced inside the barrel 17 is dependent on the placement of the annular ring 34 around the body 28 of the plunger 14, as described hereinabove. When the means 24 for controlling the flow of power is engaged, for example by a user engaging the switch 25, the power source 22 provides power to the striking rod 31 as described hereinabove. The striking rod 31 thrusts away from the power source 22 and toward the plunging rod 36. The striking rod 31 hits the plunging rod 36, thereby propelling the plunging rod 36 away from the barrel 17 and compressing the spring 48. The rest of the plunger 14 is held stationary by the threaded engagement between the plunger 14 and the barrel 17; the plunging rod 36 therefore slidably moves within the plunger 14 upon being struck by the striking rod 31.

The striking rod 31 retreats from the point of impact, propelled backward by both the impact and the spring 90 wrapped around the striking rod, then is thrust forward again by the power source 22 as described hereinabove. The plunging rod 36 concurrently is driven forward by the impact until the tip 50, or the removable second tip 52, comes into contact with the person to be treated. Upon contacting the person to be treated, the spring 48 recoils and forces the plunging rod 36 back toward the striking rod 31. When the power source 22 has impelled the striking rod 31 sufficiently forward, and the spring 48 has impelled the plunging rod 36 sufficiently backward, the striking rod 31 hits the plunging rod 36 again and propels the plunging rod 36 into another contact with the person being treated.

The force of the impacts between the striking rod 31 and the plunging rod 36 is dependent on the initial location of the plunging rod relative to the striking rod. The closer the plunging rod 36 is to the striking rod 31, the more forceful the impact. The initial location of the plunging rod 36 relative to the striking rod 31 is dependent on the location of the annular ring 34 between the ends of the body 28 of the plunger 14, as described hereinabove. If the annular ring is closer to the first end 30 of the body 28, less of the body 28 may enter the barrel 17, and thus the initial position of the rod 36 is farther from the striking rod 31. If the annular ring 34 is farther from the first end 30 of the body 28, more of the body 28 may enter the barrel 17, and thus the initial position of the plunging rod 36 is closer to the striking rod 31. Therefore, by moving the annular ring closer to or farther from the first end 30 of the body 28, the force of the impacts between the striking rod 31 and the plunging rod 36 are lessened or increased respectively.

Depending on the positioning of the annular ring 34 on the body 28 of the plunger 14, and depending on the power source 22, the plunging rod 36 can contact the person being treated at any of a range of rates and force levels, one such rate being thirty times per second. The constant tapping by the plunging rod 36 provides therapeutic treatment to the person being treated.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

Having, thus, described the invention, what is claimed is:

1. An impact tool, the tool comprising:

(a) a housing, the housing having an open end;

(b) a striker assembly disposed within the housing and secured thereto, the striker assembly comprising:

(1) an axially reciprocating striking rod, said striking rod having force receiving end and a force transmitting end, (2) means for biasing the striking rod in a direction away from said open end, (3) a drive gear assembly rotatably connected to a power source to provide operational power to the striker assembly, (4) a drive shaft affixed to the drive gear and rotatable therewith, and (5) a wheel mounted on the drive shaft and rotatable therewith, the wheel having a surface thereof inclined to the axis of rotation for driving the force receiving end of the striking rod towards the open end, (c) a plunger assembly threadably secured to the open end of said housing for movement inwardly and outwardly of the opening thereof with at least a portion thereof being disposed externally to the housing, the plunger assembly comprising:

(1) a hollow body having an exterior surface, (2) a plunging rod mounted for axially reciprocating movement in said plunger assembly, said plunging rod having a forward end externally of the hollow body for contacting a human body and a rearward end being in communication with the force transmitting end of the striking rod through the open end in the housing, and (3) means for normally biasing the plunging rod in a direction substantially opposite the biasing direction of said striking rod, and (d) an annular ring movably connected to the exterior surface of said hollow body, said annular ring being selectively positionable relative to the plunger assembly and having an abutment face for engaging the housing, the annular ring once positioned operating to permit only a desired amount of movement of the plunger assembly in a direction inwardly of said housing and thereby to position the rearward end of the plunging rod relative to the force transmitting end of the striking rod lessen or increase the force of the impacts between the plunging rod and the striking rod.

2. The tool of claim 1 wherein the housing comprises a barrel portion proximate the open end thereof, the barrel portion having an inner surface and an outer surface with at least a portion of the inner surface of the barrel portion proximate the open end being threaded, the hollow body of the plunger assembly has a threaded outer surface, the threaded outer surface being threadably engaged with the thread on the inner surface of the barrel portion, and the annular ring has a threaded inner surface, the threaded inner surface of the annular ring threadably engaging with the threaded outer surface of the hollow body of the plunger assembly.

3. The tool of claim 2 wherein the striker assembly further comprises a frame, the frame being secured to the barrel portion of the housing.

4. The tool of claim 3 wherein the striking rod is slidably attached to the frame.

5. The tool of claim 1 further comprising manually operated switch means for controlling the power source.

6. The tool of claim 5 wherein the hollow body of the plunger assembly shape comprises a substantially cylindrical shape, the body adapted to be insertable into the barrel and removably securable thereto, the power source is disposed within said housing in operable relation to said striker assembly and to said means for controlling the power source.

7. The tool of claim 1 further comprising a tip, the tip being secured to the forward end of the plunging rod.

8. The tool of claim 7 further comprising a removable second tip, the removable second tip disposed about the tip.

* * * * *